US008057570B2

(12) United States Patent
Hayman et al.

(10) Patent No.: US 8,057,570 B2
(45) Date of Patent: Nov. 15, 2011

(54) ELECTRIC ARC FURNACE STEELMAKING

(75) Inventors: Christopher Martin Hayman, Rio de Janeiro (BR); Stephan Heinz Josef Victor Weber, South Perth (AU)

(73) Assignee: Technological Resources Pty. Limited, Melbourne (AU)

( * ) Notice: Subject to any disclaimer, the term of this patent is extended or adjusted under 35 U.S.C. 154(b) by 491 days.

(21) Appl. No.: 11/665,057

(22) PCT Filed: Oct. 10, 2005

(86) PCT No.: PCT/AU2005/001558

§ 371 (c)(1),
(2), (4) Date: Aug. 3, 2009

(87) PCT Pub. No.: WO2006/039744

PCT Pub. Date: Apr. 20, 2006

(65) Prior Publication Data

US 2009/0293671 A1 Dec. 3, 2009

(30) Foreign Application Priority Data

Oct. 11, 2004 (AU) ..... 2004905820

(51) Int. Cl.
*C21B 13/12* (2006.01)
*C21C 7/064* (2006.01)

(52) U.S. Cl. ..... 75/10.6; 75/10.63; 75/584

(58) Field of Classification Search ..... 75/584, 75/10.6, 10.63
See application file for complete search history.

(56) References Cited

U.S. PATENT DOCUMENTS

| | | | | |
|---|---|---|---|---|
| 5,403,381 | A * | 4/1995 | Areaux | 75/708 |
| 6,284,018 | B1 * | 9/2001 | Uragami et al. | 75/504 |
| 6,314,123 | B1 | 11/2001 | Burgmann et al. | |
| 6,740,138 | B2 * | 5/2004 | Amano et al. | 75/10.66 |

FOREIGN PATENT DOCUMENTS

| | | |
|---|---|---|
| AU | 766100 | 1/2000 |
| AU | 768628 | 1/2000 |
| DE | 3836549 C1 | 10/1988 |
| WO | WO 01/86006 A2 | 11/2001 |

OTHER PUBLICATIONS

International Search Report and Written Opinion issued in PCT International Application No. PCT/AU2005/001558 mailed Dec. 5, 2005 (10 pages).

* cited by examiner

*Primary Examiner* — George Wyszomierski
*Assistant Examiner* — Tima M McGurthy Banks
(74) *Attorney, Agent, or Firm* — Finnegan, Henderson, Farabow, Garrett & Dunner, L.L.P.

(57) ABSTRACT

Efficient coordination of processing (by desulphurizing) and moving hot metal from a direct smelter, producing hot metal on a continuous basis, to an electric arc furnace or furnaces, operating on a batch basis, is disclosed. The invention includes the use of hot metal storage devices, such as ladles, that are large enough to supply hot metal for a small number, preferably two or three, of electric arc furnace batch operations.

16 Claims, 1 Drawing Sheet

ELECTRIC ARC FURNACE STEELMAKING

Figure 1:
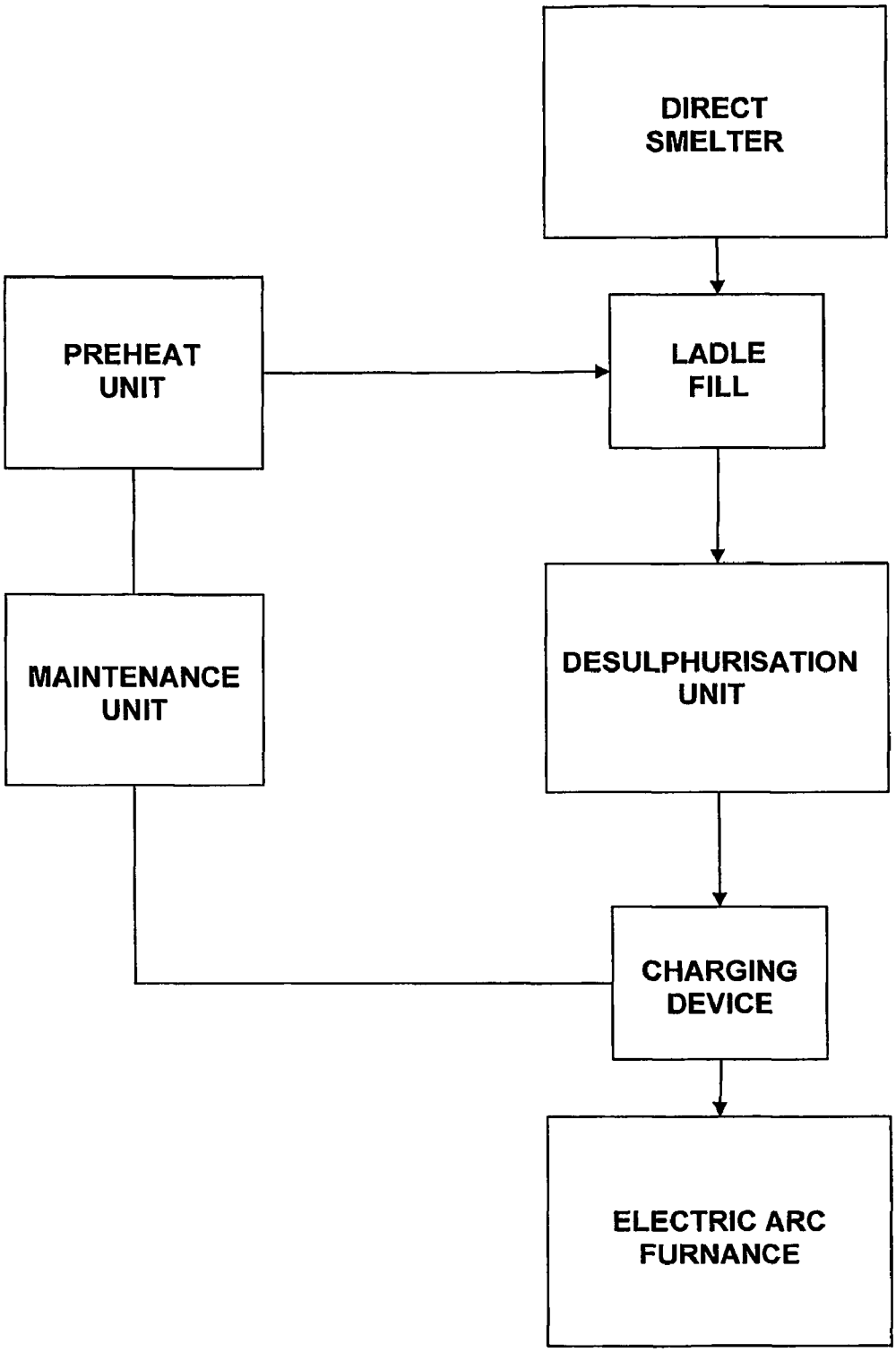

This application is a 371 of PCT/AU2005/001558 filed Oct. 10, 2005.

The present invention relates to electric arc furnace steelmaking.

The present invention relates particularly to coordinating processing of molten iron, hereinafter referred to as "hot metal", in and moving hot metal between the following unit operations:

(a) a direct smelter that produces hot metal on a batch or a continuous basis;

(b) a desulphurisation unit that desulphurises hot metal on a batch basis; and (c) an electric arc furnace that produces molten steel from feed materials, including desulphurised hot metal, on a batch basis and produces batches, hereinafter referred to as "heats", of molten steel and requires input batches of feed materials to produce each heat.

The above-described combination of unit operations and the requirement of maintaining hot metal above predetermined temperatures in order to avoid metal freezing presents significant issues in terms of processing hot metal in the unit operations and moving hot metal between the unit operations so as to achieve the ultimate objective of efficiently producing heats of molten steel.

One of the key issues is the selection of a ladle size to transfer hot metal from the direct smelter to the desulphurisation unit and from the desulphurisation unit to a charging device of the electric arc furnace.

There are a number of factors that affect the selection of minimum and maximum ladle sizes.

The factors include, by way of example, hot metal temperature from the direct smelter, the liquidus temperature of hot metal, cooling rate of hot metal in the ladle, desulphurisation time, transfer time between the direct smelter and the desulphurisation unit, transfer time between the desulphurisation unit and the electric arc furnace charging device, and hold time at the electric arc furnace(s).

The factors have different, and often competing, effects on ladle size selection.

For example, when the flow rate of hot metal from a direct smelter operating on a continuous basis are relatively high, the ladle size should be sufficiently large so that a reasonable amount of time is required to fill the ladle. However, as the ladle size increases it becomes increasingly less likely that all of the hot metal in the ladle can be used in one batch operation of an electric arc furnace. When the ladle size increases to a stage at which the hot metal in the ladle can not be used in one batch operation of an electric arc furnace, the hot metal holding time becomes an issue and places a limitation on the maximum ladle size. Similar considerations apply for direct smelters operating on a batch basis.

The applicant has realised that efficient coordination of processing and moving hot metal can be achieved by using ladles (or other hot metal storage devices) that are large enough to supply hot metal for a small number, preferably two or three, of electric arc furnace batch operations.

The single FIGURE depicts a schematic flow chart of one embodiment of the present invention.

According to the present invention there is provided a method of transferring hot metal from a direct smelter to one or more than one electric arc furnace that includes the steps of:

(a) tapping hot metal from the direct smelter at a temperature of at least 1400° C. into a hot metal storage device;

(b) desulphurising the hot metal; and (c) charging the desulphurised hot metal into one or more than one electric arc furnace and producing at least two heats of molten steel.

The above-described method makes it possible to use reasonable-sized ladles for receiving hot metal from the direct smelter. This is important from the viewpoint of tapping hot metal from the direct smelter. The method also makes it possible to hold the hot metal, preferably after it has been desulphurised, away from the direct smelter and, preferably, close to the electric arc furnace or furnaces. This is also important from the viewpoint of efficient operation of the direct smelter, the desulphurising unit, and the electric arc furnace or furnaces.

Step (a) may include tapping hot metal from the direct smelter on a batch basis or on a continuous basis.

Preferably step (b) includes desulphurising the hot metal in the hot metal storage device.

Preferably step (c) includes charging a first amount of desulphurised hot metal from the hot metal storage device into one electric arc furnace, holding the remainder of the desulphurised hot metal in the hot metal storage device until a further amount of the desulphurised hot metal in the hot metal storage device is required to produce a successive heat of steel in the electric arc furnace or a heat of steel in another electric arc furnace, and thereafter charging a further amount of desulphurised hot metal from the hot metal storage device into the or another electric arc furnace.

Step (c) may include charging the desulphurised hot metal directly from the hot metal storage device into the electric arc furnace or furnaces.

Step (c) may also include charging the desulphurised hot metal indirectly from the hot metal storage device into the electric arc furnace or furnaces by means of a charging device.

Preferably the method includes holding the hot metal tapped from the direct smelter at a temperature of at least 1300° C. prior to charging the hot metal into the electric arc furnace or furnaces in step (c).

Preferably the step of holding the temperature of the desulphurised hot metal above 1300° C. does not include heating hot metal via an external heat source while the hot metal is being held prior to charging the hot metal into the electric arc furnace or furnaces in step (c).

Preferably steps (a), (b), and (c) of the method are completed in less than 100 minutes.

Preferably step (b) includes desulphurising the hot metal on a batch basis.

Preferably step (b) includes desulphurising the hot metal to less than 0.055 wt. % S in the hot metal storage device.

Preferably step (c) includes successively charging desulphurised hot metal into one electric arc furnace for producing at least two heats of molten steel in the furnace in situations in which the furnace has an annual production rate of less than 1 million tonnes of molten steel.

Preferably step (c) includes charging desulphurised hot metal into two or more than two electric arc furnaces for producing at least two heats of molten steel in the furnaces in situations in which each furnace has an annual production rate of at least 1 million tonnes of molten steel.

Preferably the method includes returning the hot metal storage device to the direct smelter.

The hot metal storage device may be any suitable apparatus for holding hot metal.

Suitable hot metal storage devices include, by way of example, ladles and torpedo cars.

Preferably the hot metal storage device is a ladle.

Preferably the method includes positioning a lid on the ladle after desulphurisation to minimise heat loss from the ladle.

The charging device may be any suitable device that can facilitate charging of desulphurised hot metal from the hot metal storage device into the electric arc furnace or furnaces.

The charging device may include a launder or a tundish.

According to the present invention there is also provided a method of producing a heat of molten steel in an electric arc furnace that includes a step of charging a predetermined amount of hot metal that has been transferred to the furnace by the above-described transfer method into the furnace.

In more specific terms, according to the present invention there is provided a method of producing a heat of molten steel in an electric arc furnace that includes steps of:

(a) charging a predetermined amount of solid feed materials, including any one or more than one of scrap steel, solid pig iron, direct reduced iron ("DRI"), and hot briquetted iron ("HBI"), into the furnace;

(b) melting the solid feed materials in the furnace by supplying electrical and/or chemical energy to the furnace and forming a bath of molten material;

(c) charging a predetermined amount of hot metal transferred to the furnace by the above-described method into the furnace during the course of melting step (b);

(d) refining the molten material in the furnace to a required steel chemistry, (e) deslagging the furnace; and (f) tapping the heat of molten steel from the furnace.

Typically, hot metal amounts to 30-35 wt. % of the total of the feed materials for producing each heat of molten steel.

The present invention is described further by way of example with reference to the accompanying flowsheet of one embodiment of a method of transferring hot metal to an electric arc furnace in accordance with the present invention.

With reference to the flowsheet, hot metal is discharged continuously from a direct smelter at a temperature of the order of 1450° C. into a hot metal storage device in the form of an 80 tonne ladle.

The direct smelter may be any suitable direct smelter for continuously producing hot metal. Typically, the direct smelter produces at least 800,000 t/y hot metal.

By way of example, the direct smelter may be a HIsmelt direct smelter for producing hot metal in accordance with the HIsmelt process. The HIsmelt direct smelter and direct smelting process are described in a number of patents and patent applications including, by way of example, Australian patents 766100 and 768628 in the name of the applicant.

Typically, hot metal discharges continuously from the direct smelter at a flow rate of 1.7 t/min and, consequently, the ladle fills in approximately 45 minutes.

After the ladle is full, the ladle is transferred by way of a suitable transfer car to a desulphurisation unit and the hot metal is desulphurised at the unit on a batch basis, typically to a sulphur content of less than 0.055 wt. % and the slag that is generated during the desulphurisation step is removed from the ladle.

Typically, the desulphurisation time is approximately 20 minutes.

After the hot metal is desulphurised and de-slagged, the ladle is transferred on the above-mentioned transfer car to an electric arc furnace and is positioned in relation to a charging device that can facilitate supply of hot metal from the ladle into the furnace. By way of example, the charging device may include a launder or a tundish or other suitable means for transferring ht metal discharged from the ladle into the furnace.

The ladle is held at the electric arc furnace until the furnace is in a melting step of the furnace. At that time, 40 tonnes of the hot metal in the ladle is discharged from the ladle into the furnace, by means of the charging device. The hot metal contributes to the production of a heat of molten steel in the furnace.

The remaining 40 tonnes of hot metal is held in the ladle while the electric arc furnace produces the above-mentioned heat of molten steel.

Thereafter, the remaining hot metal is discharged from the ladle into the furnace by means of the charging device during the melting step of the next cycle of the furnace.

Depending on the cycle of the electric arc furnace, the hold time of hot metal in the ladle will vary accordingly. Desirably, the hold time is kept to a minimum and bearing in mind that a minimum hold temperature is approximately 1320° C.

The tap-tap time for an electric arc furnace is a function of factors such as the transformer capacity of the furnace and the oxygen injection rate into the furnace.

Typically, the tap-tap time for an electric arc furnace producing a 130 tonne heat of molten steel is of the order of 35-60 minutes. The 40 tonne charge of hot metal represents approximately 30-40 wt. % of the heat.

In order to minimise heat loss from the ladle, a lid is placed on the ladle while the ladle is at the electric arc furnace.

After all of the hot metal has been discharged from the ladle, the ladle is transferred by the transfer car to a maintenance unit and is cleaned in order to prepare the ladle for re-use in the method.

Thereafter, the cleaned ladle is transferred to a preheat unit and is preheated at the unit before being returned to the direct smelter.

In any situation, the number of ladles required will vary depending on a large number of factors, including the capacity of the ladles, the production rate of the direct smelter, the tap temperature of the hot metal, the number of electric arc furnaces, the tap-tap time of the electric arc furnaces, and the relative locations of the direct smelter and the electric arc furnaces.

Many modifications may be made to the embodiment of the present invention described above without departing from the spirit and scope of the invention.

By way of example, whilst the above-described embodiment includes supplying two 40 tonne batches of hot metal to produce successive heats of molten steel in a single electric arc furnace, the present invention is not so limited and extends (a) to supplying smaller batches of hot metal to produce more than two successive heats of hot metal in the furnace and (b) to supplying two or more batches of hot metal to two or more electric arc furnaces.

In addition, whilst the above-described embodiment is described in the context of a 80 tonne ladle, the present invention is not limited to ladles of this capacity and extends to ladles of any capacities.

In addition, the present invention is not limited to the use of ladles and extends to any suitable hot metal storage devices. By way of example, the present invention extends to the use of torpedo cars as hot metal storage devices.

In view of the heat insulating characteristics of torpedo cars, torpedo cars are particularly suited for use as hot metal storage devices in situations in which heat loss is a significant issue.

By way of example, the present invention extends to using torpedo cars to store and transport hot metal from a direct smelter to a desulphurisation unit.

This method further includes, by way of example, transferring hot metal to one or more than one ladle at the desulphurisation unit, desulphurising the hot metal in the ladle or ladles, and thereafter discharging the hot metal into one or more than one electric arc furnace.

By way of further example, the present invention extends to using torpedo cars to store and transport hot metal from a direct smelter to a desulphurisation unit, desulphurising the hot metal in each torpedo car in turn and discharging the desulphurised hot metal directly from each torpedo car in turn into one or more than one electric arc furnace.

The invention claimed is:

1. A method of transferring hot metal from a direct smelter to one or more than one electric arc furnaces that includes the steps of:

(a) tapping hot metal from the direct smelter at a temperature of at least 1400° C. into a hot metal storage device;

(b) desulphurising the hot metal;

(c) charging the desulphurised hot metal from the hot metal storage device into one or more than one electric arc furnaces located away from the direct smelter and producing at least two heats of molten steel; and (d) returning the hot metal storage device to the direct smelter.

2. The method defined in claim 1 wherein step (b) includes desulphurising the hot metal in the hot metal storage device.

3. The method defined in claim 1 wherein step (c) includes charging a first amount of desulphurised hot metal from the hot metal storage device into one electric arc furnace, holding the remainder of the desulphurised hot metal in the hot metal storage device until a further amount of the desulphurised hot metal in the hot metal storage device is required to produce a successive heat of steel in the electric arc furnace or a heat of steel in another electric arc furnace, and thereafter charging a further amount of desulphurised hot metal from the hot metal storage device into the electric arc furnace or another electric arc furnace.

4. The method defined in claim 3 wherein step (c) includes charging the desulphurised hot metal directly from the hot metal storage device into the electric arc furnace or furnaces.

5. The method defined in claim 3 wherein step (c) includes charging the desulphurised hot metal indirectly from the hot metal storage device into the electric arc furnace or furnaces by means of a charging device.

6. The method defined in any one of claims 3 to 5 includes holding the hot metal tapped from the direct smelter at a temperature of at least 1300° C. prior to charging the hot metal into the electric arc furnace or furnaces in step (a).

7. The method defined in claim 6 includes holding the hot metal tapped from the direct smelter at a temperature of at least 1300° C. prior to charging the hot metal into the electric arc furnace or furnaces in step (c) without the use of external heating to maintain the molten metal temperature.

8. The method defined in claim 5 wherein the charging device includes a launder.

9. The method defined in claim 1 wherein step (b) includes desulphurising the hot metal on a batch basis.

10. The method defined in claim 1 wherein step (b) includes desulphurising the hot metal to less than 0.055 wt. % S in the hot metal storage device.

11. The method defined in claim 1 wherein step (c) includes successively charging desulphurised hot metal into one electric arc furnace for producing at least two heats of molten steel in the furnace for a furnace having an annual production rate of less than 1 million tonnes of molten steel.

12. The method defined in claim 1 wherein step (c) includes charging desulphurised hot metal into two or more than two electric arc furnaces for producing at least two heats of molten steel in the furnaces for furnaces each having an annual production rate of at least 1 million tonnes of molten steel.

13. The method defined in claim 1 wherein the hot metal storage device includes a ladle or a torpedo car.

14. A method of producing a heat of molten steel in an electric arc furnace that includes a step of charging a predetermined amount of hot metal that has been transferred to the furnace by the method defined in claim 1.

15. A method of producing a heat of molten steel in an electric arc furnace that includes steps of:

(a) charging a predetermined amount of solid feed materials, including any one or more than one of scrap steel, solid pig iron, direct reduced iron ("DRI"), and hot briquetted iron ("HBI"), into the furnace;

(b) melting the solid feed materials in the furnace by supplying electrical and/or chemical energy to the furnace and forming a bath of molten material;

(c) charging a predetermined amount of hot metal transferred to the furnace by the method defined in claim 1 into the furnace during the course of melting step (b);

(d) refining the molten material in the furnace to a required steel chemistry, (e) deslagging the furnace; and (f) tapping the heat of molten steel from the furnace.

16. The method defined in claim 15 wherein hot metal amounts to 30-35 wt % of the total of the feed materials for producing each heat of molten steel.

* * * * *